US010394164B1

(12) United States Patent
Stafford et al.

(10) Patent No.: US 10,394,164 B1
(45) Date of Patent: Aug. 27, 2019

(54) ANGLED RIDGES ON ELECTROSTATIC PROCESS UNIT SHAFTS

(71) Applicants: Kabushiki Kaisha Toshiba, Minato-ku (JP); Toshiba TEC Kabushiki Kaisha, Shinagawa-ku (JP)

(72) Inventors: Don W. Stafford, Lexington, KY (US); Donn D. Bryant, Lexington, KY (US); Michael W. Lawrence, Lexington, KY (US)

(73) Assignees: Kabushiki Kaisha Toshiba, Minato-ku (JP); Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 15/892,917

(22) Filed: Feb. 9, 2018

(51) Int. Cl.
*G03G 15/08* (2006.01)
*G03G 15/095* (2006.01)

(52) U.S. Cl.
CPC ..... *G03G 15/095* (2013.01); *G03G 15/0881* (2013.01); *G03G 15/0891* (2013.01); *G03G 2215/0827* (2013.01); *G03G 2221/0005* (2013.01)

(58) Field of Classification Search
CPC ..... G03G 15/0817; G03G 15/0898; G03G 15/0942; G03G 2221/1648
See application file for complete search history.

(56) References Cited

U.S. PATENT DOCUMENTS

| | | | | |
|---|---|---|---|---|
| 8,050,596 | B2 * | 11/2011 | Jun | G03G 15/0877 399/260 |
| 8,213,837 | B2 * | 7/2012 | Wayman | G03G 15/0817 399/102 |
| 9,983,511 | B2 * | 5/2018 | Sakamaki | G03G 15/0891 |
| 2008/0310889 | A1 * | 12/2008 | Nishikawa | G03G 15/0818 399/286 |
| 2011/0176839 | A1 * | 7/2011 | Gonda | G03G 15/0887 399/263 |
| 2014/0199098 | A1 * | 7/2014 | Abe | G03G 15/0818 399/279 |
| 2015/0177648 | A1 * | 6/2015 | Morishita | G03G 15/0886 399/358 |

* cited by examiner

*Primary Examiner* — Sevan A Aydin
(74) *Attorney, Agent, or Firm* — Ulmer & Berne LLP

(57) ABSTRACT

A system and method for urging stray toner away from sealing areas on rotating shafts in electrostatic process units includes a shaft that is associated with a rotating component of the electrostatic process unit such as a toner mixer, a waste auger, a developer, or a photoconductive drum. The shaft includes sealing areas at either end of the shaft that are configured to prevent toner leakage through the sealing areas, and protruding ridges in the sealing areas that encircle the shaft. The protruding ridges are angled relative to the axis of the shaft such that rotation of the shaft causes the protruding ridges to urge stray toner away from the sealing areas. The protruding ridges substantially reduce toner leakage through the sealing areas of rotating shafts of electrostatic process units.

19 Claims, 4 Drawing Sheets

ANGLED RIDGES ON ELECTROSTATIC PROCESS UNIT SHAFTS

TECHNICAL FIELD

This application relates generally to devices to prevent toner from leaking through seals of rotating components in electrostatic process units (EPU), and more particularly to angle ridges on shafts that move stray toner away from sealing areas of rotating EPU components.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

An electrostatic process unit (EPU) in many toner-based printers and multifunction peripherals performs the printing function. The EPU typically comprises a photoconductive drum, and a developer roller, and can include a charge unit, a toner hopper, a semiconductor laser, and developer among other components as would be known in the art. The EPU can be configured as a field replaceable unit or can be part of a self-contained compact cartridge that includes the toner. Using magnetic and electrostatic forces, the developer roller and the photoconductive drum transfer toner from a toner hopper to a sheet of paper where it is fused by heat to the paper. After the photoconductive drum transfers toner to the paper, a cleaner blade in the EPU removes residual toner and paper dust from the photoconductive drum.

During normal operation residual toner and paper dust can leak through seals into unintended areas of the EPU causing operational problems. For example, small amounts of stray toner can move along rotating shafts of components inside the EPU and leak through sealing areas intended to prevent that toner from entering bearings or leaking to other parts of the printer. Toner leakage can interfere with the proper operation of the electrostatic process unit as well as other parts of the printer.

SUMMARY

Figure 1:
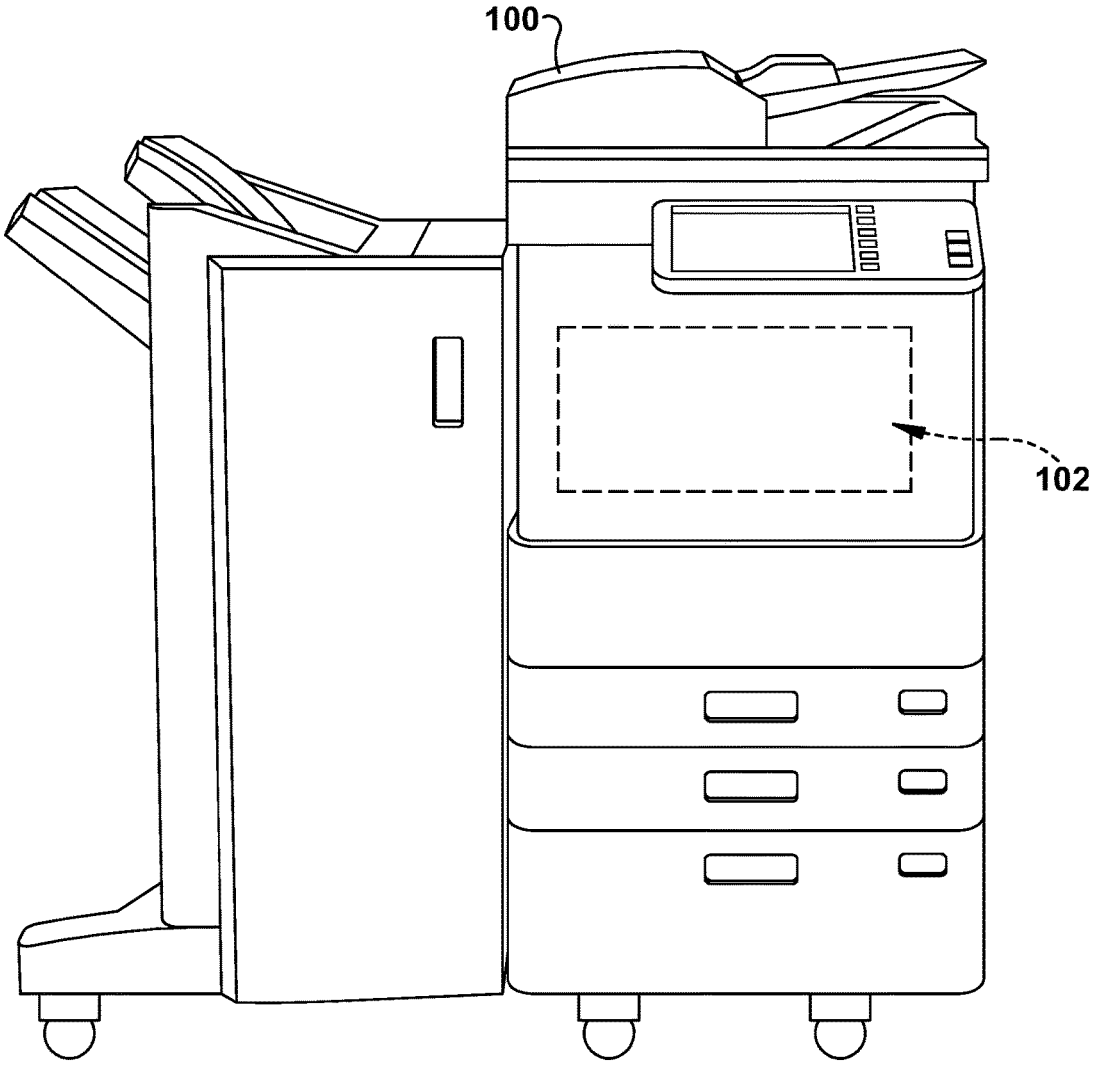
FIG. 1 is a block diagram of a multifunction peripheral.

In an example embodiment, an apparatus includes components of an electrostatic process unit (EPU) including a rotatable component that has an associated shaft. The shaft includes one or more sealing areas and one or more angled ridges in each sealing area. The sealing area inhibits leakage of particulate such as stray toner through the sealing area. The angled ridges are configured to directionally urge particulate contacting the angled ridges away from the sealing area as the shaft is rotated. The angled ridges are angled between 10 and 80 degrees relative to the axis of the shaft, for example at an angle of approximately 70 degrees.

In an example embodiment, an electrostatic process unit includes one or more toner mixers, a developer roller, a photoconductive drum, and optionally a waste toner auger, each of which includes an associated shaft. At least one of the shafts includes a sealing area that is configured to inhibit leakage of stray toner through the sealing area, and further includes a number of angled ridges in the sealing area. The angled ridges directionally urge particulate away from the sealing area when an associated shaft is rotated.

In an example embodiment, a method includes initiating a print operation on a print engine, rotating a shaft associated with a rotatable component of an electrostatic process unit (EPU) of the print engine, and urging toner away from the sealing area while the shaft is rotated. The shaft includes a sealing area configured to inhibit toner leakage through the sealing area, and one or more angled ridges protruding from the shaft that urge the toner away from the sealing area.

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In toner-based electro-photographic printers, toner is picked up by a magnetic developer roller in an electrostatic process unit, or EPU, from a toner hopper. A leveling blade called a doctor blade is positioned close to the magnetic developer roller and removes excess toner to ensure there is only a thin even layer of toner on the magnetic developer roller. The magnetic developer roller rotates towards a photoconductive drum onto which an electric charge has been applied, and toner from the magnetic developer roller is transferred to the photoconductive drum in accordance with a desired image to be printed. The toner is then transferred from the photoconductive drum to paper via a transfer belt and fused with the paper to form a printed page. Residual toner that is left on the photoconductive drum is removed by a cleaner blade or wiper blade and moved by an auger into a waste bin. Each rotating component of the EPU can include a sealing area configured to prevent particulate, such as stray toner and paper dust which can include submicron sized calcium carbonate, from leaking along the shaft of a rotating component into unintended areas of the EPU and the printer in general. Stray toner and paper dust can contaminate future print jobs, cause bearings to wear or seize, or otherwise interfere with the proper operation of the EPU or contaminate future print jobs. Therefore reducing leakage of stray toner and paper dust can improve the quality of printed images, reduce waste, and lower maintenance costs.

With reference to FIG. 1, an example multifunction peripheral (MFP 100) is presented. The MFP 100 includes electrostatic-based, or toner-based, printing hardware 102 for performing printing operations as would be understood in the art.

Figure 2A:
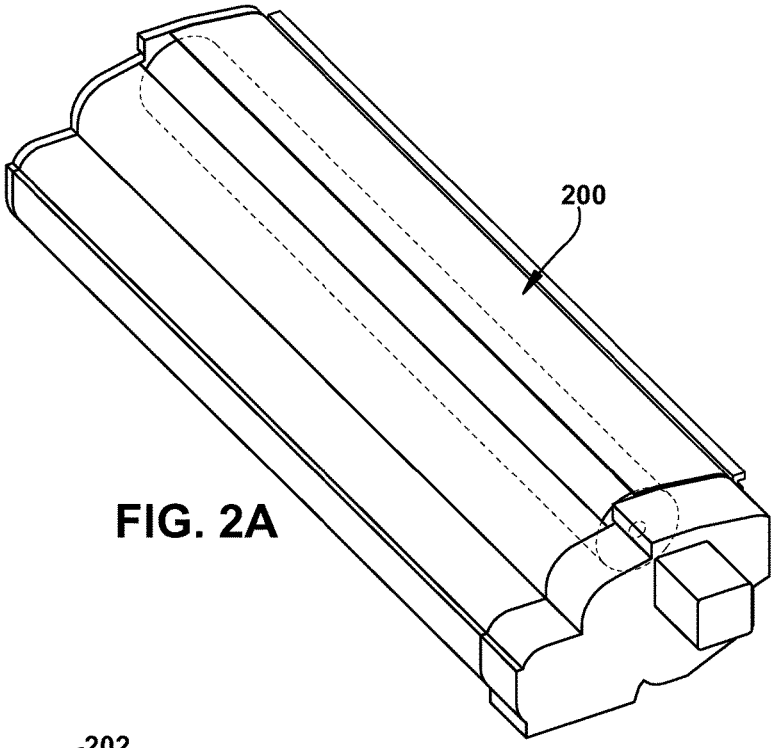
FIG. 2A is a diagram of an example electrostatic process unit.
Figure 2B:
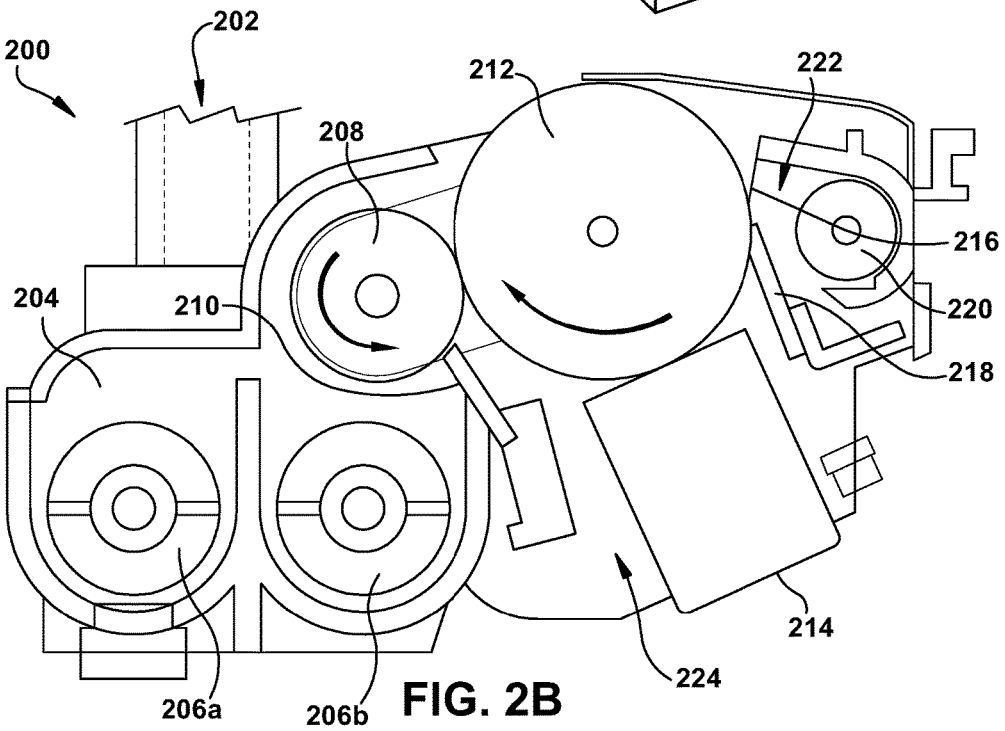
FIG. 2B is a diagram of components of an example electrostatic process unit.

With reference to FIGS. 2A and 2B, diagrams of an electrostatic process unit 200 of an example laser printer are presented. The electrostatic process unit 200 receives toner 202 into a toner hopper 204 of a developer unit that includes mixers 206*a* and 206*b*. Toner 202 from the toner hopper 204 is picked up by the developer 208 that rotates towards a doctor blade 210. The doctor blade 210 removes excess toner 202 from the developer 208 leaving a thin evenly distributed layer of toner 202 on the developer 208. The developer 208 rotates towards the photoconductive drum 212. The photoconductive drum 212 is charged by a charger unit 214 which can include a primary charge roller (not shown), and a laser (not shown) associated with the printer produces the image to be printed on the photoconductive drum 212.

As the photoconductive drum 212 rotates, toner 202 on the photoconductive drum 212 is selectively pulled from developer 208 to the photoconductive drum 212 in accordance to the image to printed. The photoconductive drum 212 transfers the toner 202 to a transfer belt (not shown) and then to paper (not shown) after which the toner 202 is permanently fused to the paper by a fusing assembly (not shown). After transferring toner 202 to the transfer belt, the photoconductive drum 212 continues to rotate towards a cleaner blade 218 that removes any residual toner and other particles that remain on the photoconductive drum 212. A recovery blade 216 prevents removed toner and other particles from escaping from this section of the developer cavity 222 into other parts of the developer cavity 224. An auger 220 moves waste toner and other particles out of the EPU to a suitable waste receptacle.

Figure 3:
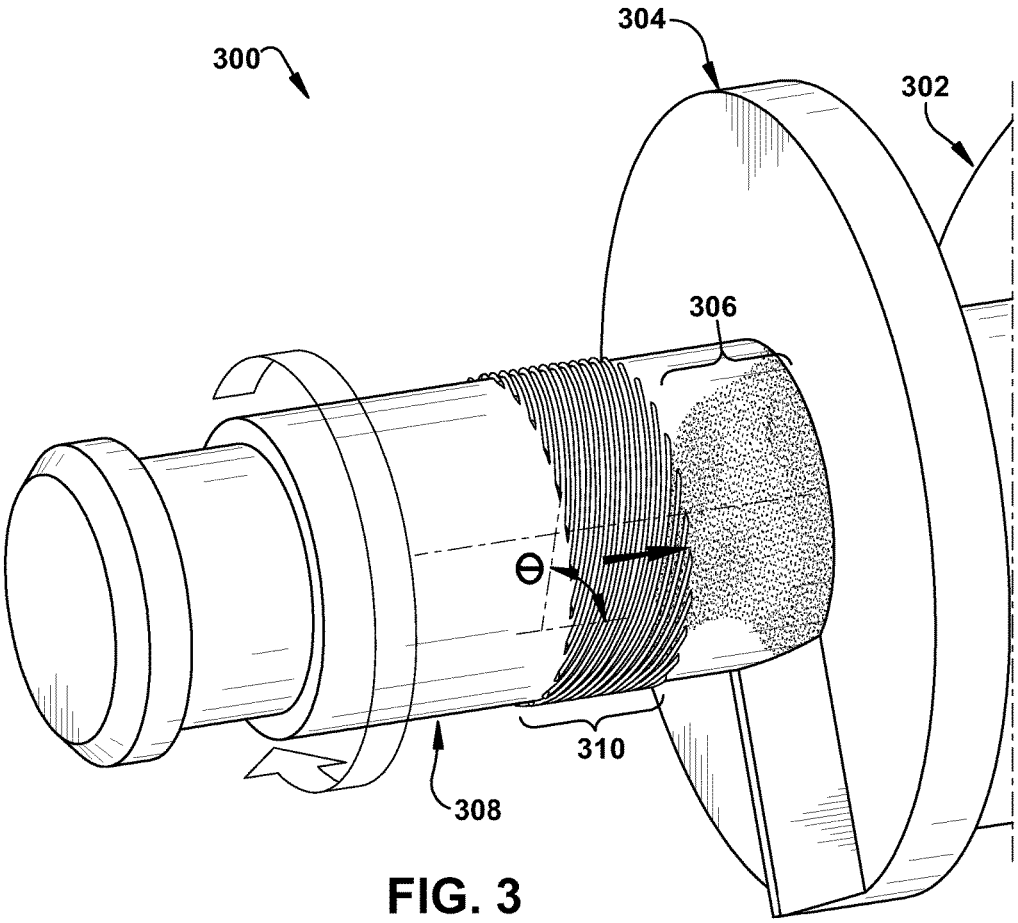
FIG. 3 is a diagram of example angled ridges on a shaft of a component of the electrostatic process unit.

With reference to FIG. 3, a shaft 300 of a rotatable component of the EPU is presented. For this example, the rotatable component is a toner mixer as described above with respect to FIG. 2, however the rotatable component is to be interpreted broadly to include any or multiple components of the EPU including a toner mixer, a developer roller, a photoconductive drum, a waste toner auger, or any other rotatable member of the EPU as would be understood in the art.

As the shaft 300 is rotated, the auger blade 302 turns and mixes the toner in the toner hopper. An end plate 304 prevents the toner from escaping from the toner hopper. However, small amounts of stray toner 306, as well as paper dust or other particulate, can migrate to the shaft 300 by escaping from the toner hopper over the end plate 304 or by escaping from other parts of the EPU. As the shaft 300 rotates during operation, the stray toner 306 on the shaft 300 can travel towards the sealing area 308 on the shaft 300. The sealing area 308 works in conjunction with a suitable seal to inhibit stray toner 306 from leaking through the sealing area 308 into other parts of the EPU or printer as would be understood in the art.

As the shaft 300 turns in the direction indicated by the arrow, angled ridges 310 on the shaft 300 urge stray toner 306 away from the sealing area 308, which can reduce the amount of stray toner 306 entering the sealing area 308 and can move stray toner 306 out of the sealing area 308. This in turn reduces the amount of stray toner 306 that leaks through the sealing area 308 into other areas of the EPU or printer, which could decrease print quality, clog bearing, cause malfunctions, or otherwise increase maintenance needs.

Any suitable number of angled ridges 310 can be used. In one embodiment, the shaft 300 can include a single angled ridge 310. In another embodiment, the shaft 300 can include multiple angled ridges 310 as illustrated. In one embodiment, the angled ridges 310 can protrude outward from the shaft 300. In other embodiments, the angled ridges 310 can be textures or indentations in the shaft 300. In various embodiments, the angled ridges 310 can be across part of the sealing area 308, can extend across the entire sealing area 308, or can be adjacent to the sealing area 308. In other embodiments, different angled ridges 310 can be used across different parts of the sealing area 308.

The angled ridges 310 can be oriented so as to encircle all or a portion of the shaft 300. The angled ridges 310 can be oriented with any suitable pitch, or angle θ relative to the axis of the shaft 300. In various embodiments, the angle θ can be between approximately 10 degrees and approximately 80 degrees. The angle θ can vary depending upon the desired performance. For example, when stray toner 306 contacts angled ridges 310 at an angle θ of incidence greater than 45 degrees, for example 70 degrees, a larger proportion of the forces impinged on the stray toner 306 are in the direction of the axis of the shaft 300, as opposed to perpendicular to the axis of the shaft 300, which can improve the performance of the angled ridges 310.

In FIG. 3, only one end of the shaft 300 is illustrated. The opposing end of the shaft 300 can similarly have angled ridges 310 in the sealing area 308 on the opposite side of the shaft 300. Those angled ridges 310 would be oriented in the opposite orientation, or reversed, such that when the shaft 300 is rotated the angled ridges 310 would be in a correct orientation to urge stray toner 306 and other particulate away from the corresponding sealing area 308.

Using angled ridges 310 on a rotatable shaft 300 can reduce the amount of stray toner 306 that reaches the sealing area 308 and can remove stray toner 306 in the sealing area 308. By reducing the amount of stray toner 306 that enters the sealing area 308 or leaks into other parts of the printer, the angled ridges 310 decrease the amount of periodic maintenance required by technicians and increase the useful lifespan of the EPU components and the printer in general.

Figure 4:
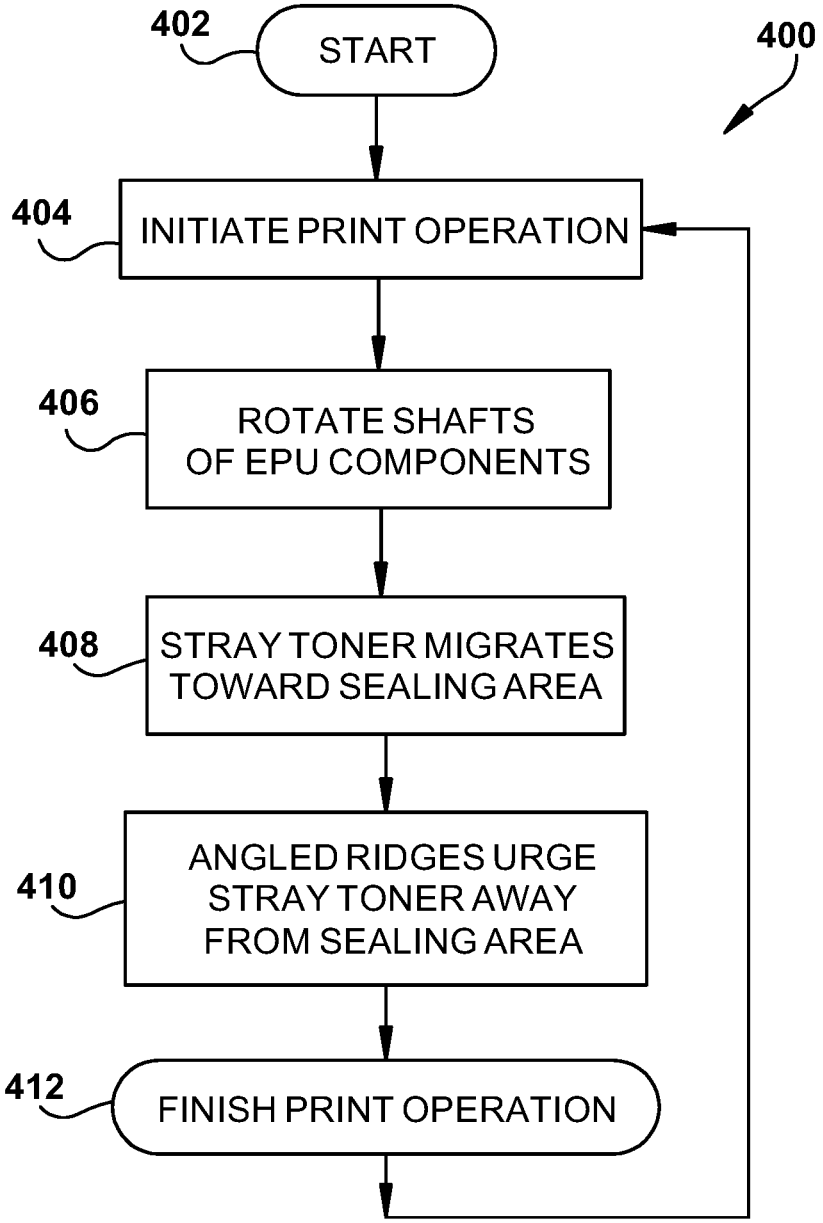
FIG. 4 is a flowchart of example operations of urging toner and paper dust away from sealing areas on rotating shafts of an electrostatic process unit of a toner-based printer.

With reference to FIG. 4, an example flowchart 400 of operations for urging toner and paper dust away from sealing areas on rotating shafts of an EPU of a toner-based printer. Processing commences at start block 402 and proceeds to process block 404.

At process block 404, a print operation is initiated on the printer, for example in response to receiving a print request to print a document. Processing continues to process block 406.

At process block 406, in response to initiating the print operation, certain components of the EPU rotate in a coordinated fashion as describe in detail above, including the toner mixers, the photoconductive drum, the developer roller, and the waste toner auger. Shafts associated with one or more of the rotating components can include sealing areas that help to prevent stray toner from leaking out of the EPU or into other areas of the EPU. Processing continues to process block 408.

At process block 408, as the shafts rotate, stray toner or other dust particles can migrate along the shafts towards the sealing areas. Processing continues to process block 410.

At process block 410, as the shafts continue to rotate, angled ridges on the shaft urge the stray toner and dust away from sealing areas, thereby improving the operation of the seals. Processing continues to process block 412.

At process block 412, the print operation is completed, and the EPU performs any necessary operations to configure the components for the next print job. Processing then returns to process block 404 where the next print job is received and the cycle is repeated. Processing can terminate at any suitable block, for example when the printer finishes a print job, when the printer enters a sleep or idle mode, or when the printer is turned off.

In light of the foregoing, it should be appreciated that the present disclosure significantly advances the art of removing residual toner and other particles from the photoconductive drum of a toner-based print unit. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a shaft associated with a rotatable component of an electrostatic process unit (EPU), the shaft including an auger configured to urge toner in the EPU toward a center of the shaft, an end plate disposed between the auger and a sealing area configured to inhibit leakage of particulate through the sealing area, a stray toner area disposed between the end plate and a plurality of angled ridges on a surface of the shaft in the sealing area and configured to directionally and cooperatively urge particulate contacting the angled ridge toward the stray toner area when the shaft is rotated.

2. The apparatus of claim 1, wherein the shaft further includes:

one or more additional angled ridges uniformly oriented relative to the angled ridge.

3. The apparatus of claim 2, wherein each angled ridge is angled between 10 degrees to about 80 degrees relative to an axis of the shaft.

4. The apparatus of claim 3, wherein each angled ridge is angled greater than 45 degrees relative to the axis of the shaft.

5. The apparatus of claim 2, wherein each angled ridge is angled at least 70 degrees relative to the axis of the shaft.

6. The apparatus of claim 1, wherein each angled ridge at least partially encircles the shaft.

7. The apparatus of claim 1, wherein each angled ridge protrudes from the shaft.

8. The apparatus of claim 1, further the shaft further comprises:

a second sealing area configured to inhibit leakage of particulate through the second sealing area, and a plurality of second angled ridges displaced about the shaft in the second sealing area configured to directionally urge particulate contacting the second angled ridge away from the second sealing area when the shaft is rotated.

9. The apparatus of claim 8, wherein the angled ridges are displaced near a first end of the shaft, and wherein the second angled ridges are displaced near a second end of the shaft.

10. The apparatus of claim 9, wherein the second angled ridges are oriented in an opposite, reversed, orientation than the angled ridges, and wherein both the angled ridges and the second angled ridges are configured to directionally urge particulate substantially inward toward a center of the shaft.

11. The apparatus of claim 1, further comprising:

a multifunction peripheral comprising an EPU that includes a shaft with angled ridges.

12. The apparatus of claim 1, wherein the particulate is selected from the group consisting of toner, stray toner, dust, paper dust, and particles comprising calcium carbonate.

13. An electrostatic process unit, comprising:

one or more rotatable mixers configured to stir toner;

a rotatable developer roller configured to attract at least some of the toner stirred by the one or more rotatable mixers; and a rotatable photoconductive drum configured to selectively attract toner from the developer roller and deposit the selectively attracted toner onto a paper or a transfer belt, wherein each of the rotatable mixers, the rotatable developer roller, and the rotatable photoconductive drum comprises a shaft, wherein at least one shaft includes an end plate disposed between a rotatable mixer and a sealing area configured to inhibit leakage of stray toner through the sealing area, wherein the at least one shaft further comprises a stray toner area disposed between the end plate and a plurality of angled ridges in the sealing area, and wherein the angled ridges are configured to directionally urge stray toner toward the stray toner area when the at least one shaft is rotated.

14. The electrostatic process unit of claim 13, further comprising:

an auger configured to remove waste toner from the electrostatic process unit, wherein the auger comprises a shaft that includes a sealing area and a plurality of angled ridges configured to directionally urge waste toner away from the sealing area when the shaft is rotated.

15. The electrostatic process unit of claim 13, wherein each angled ridge at least partially encircles the shaft, and wherein each angled ridge is angled relative to an axis of the shaft at an angle selected from the group consisting of an angle of at least 70 degrees, an angle greater than 45 degrees, and an angle between 10 degrees to 80 degrees.

16. The electrostatic process unit of claim 13, wherein a first subset of angled ridges is displaced inward from a first sealing area on a first end of the shaft, and wherein a second subset of angled ridges is displaced inward from a second sealing area on a second end of the shaft, and wherein each subset of angled ridges is angled so as to directionally urge toner away from an associated sealing area when the shaft is rotated.

17. A method, comprising:

initiating a print operation on a print engine;

rotating, in response to the print operation, at least one shaft associated with a rotatable component of an electrostatic process unit (EPU) of the print engine, the at least one shaft including an end plate, a sealing area configured to inhibit toner leakage through the sealing area, the sealing area including a stray toner area disposed between the end plate and a protruding angled ridge in the sealing area configured to urge toner toward the stray toner area when the shaft is rotated; and urging, by the protruding angled ridge, toner away toward the stray toner area while the shaft is rotated.

18. The method of claim 17, wherein the protruding angled ridge at least partially encircles the shaft, and wherein the protruding angled ridge is angled between 10 degrees to and 80 degrees relative to an axis of the shaft.

19. The method of claim 17, wherein the rotatable component of the EPU is selected from the group consisting of a toner mixer, a waste auger, a developer, and a photoconductive drum.

* * * * *